United States Patent [19]

Cobb

[11] Patent Number: 4,995,209

[45] Date of Patent: Feb. 26, 1991

[54] WALL CONNECTOR DEVICE

[76] Inventor: William Cobb, 75 Queen Alexandra Close S.E., Calgary, Alberta, Canada, T2J 3P9

[21] Appl. No.: 389,374

[22] Filed: Aug. 4, 1989

[51] Int. Cl.[5] ..... E04H 1/00

[52] U.S. Cl. ..... 52/238.1; 52/241; 52/243.1

[58] Field of Search ..... 52/238.1, 243.1, 484, 52/241

[56] References Cited

U.S. PATENT DOCUMENTS

| | | | |
|---|---|---|---|
| 798,738 | 9/1905 | Lundstedt | 403/262 |
| 3,378,970 | 4/1968 | Imbrecht | 52/243.1 |
| 3,596,425 | 8/1971 | Kodaras | 52/476 |
| 3,638,387 | 2/1972 | Lickliter et al. | 52/741 |
| 4,073,108 | 2/1978 | Williams | 52/238.1 |

FOREIGN PATENT DOCUMENTS

| | | | |
|---|---|---|---|
| 1098277 | 7/1978 | Canada . | |
| 1104316 | 7/1981 | Canada . | |
| 6400045 | 7/1964 | Netherlands | 52/484 |

*Primary Examiner*—James L. Ridgill, Jr.

*Attorney, Agent, or Firm*—William R. Hinds; George H. Dunsmuir

[57] ABSTRACT

When constructing walls beneath suspended ceilings of the type including T-bars, the usual practice is to connect C-shaped channel members directly to the T-bars. If the walls are disassembled or moved, unsightly holes remain in the exposed bottom surfaces of the T-bars. A simple connector for solving the problem includes a strip of material which, in use, includes a generally inverted U-shaped central portion for straddling the top stem of the T-bar, and a pair of arms perpendicular to the central portion for extending outwardly beyond the arms of the T-bar into overlapping relationship with the channel member. Screws are used to connect the device to the T-bar and to the channel member. Thus, the T-bar remains intact and undamaged.

8 Claims, 1 Drawing Sheet

WALL CONNECTOR DEVICE

BACKGROUND OF THE INVENTION

FIELD OF THE INVENTION

This invention relates to a connector device and in particular to connector device for use when constructing walls or partitions.

DISCUSSION OF THE PRIOR ART

The vast majority of office buildings are designed as skeletal concrete structures closed by outer walls. Suspended ceilings leave space between the ceiling and superjacent floors for electrical wiring and heat and air conditioning ducts. Internal walls are connected to the concrete floors and the suspended ceilings. It is common practice to attach C-shaped channel elements to the floor and ceiling for receiving metal studs. The channel elements are connected to the ceiling by the simple expedient of self trapping screws, which extend through the channel elements into the bottom, normally exposed face of the T-bars used to construct the ceiling. When a wall or partition is moved or removed, the unsightly screws holes remain in the exposed bottom surface of the T-bars.

A variety of T-bar connector devices have been proposed. Examples of such devices are found in Canadian Patents Nos. 1,104,316, which issued to J.T. Schuplin on Jul. 7, 1981 and 1,098,277, which issued to A.C. Wendt on Mar. 31, 1981 and U.S. Pat. Nos. 3,378,970, which issued to A.G. Imbrecht on Apr. 23, 1968, 3,596,425, which issued to M.J. Kodaras on Aug. 3, 1971, and 3,638,387, which issued to R.P. Lickuter et al on Feb. 1, 1972. For the most part, the patented devices are unduly complicated and thus expensive to produce.

The object of the present invention is to overcome the disadvantages of existing connectors by providing a relatively simple device for connecting walls to suspended ceilings which is easy to produce, and which does not require screws extending into the exposed surface of the T-bar.

GENERAL DESCRIPTION OF THE INVENTION

Accordingly, the present invention relates to a connector device for connecting a generally C-shaped wall channel member to the base of a T-bar used in a conventional suspended ceiling assembly comprising elongated strip means for mounting on the T-bar, in use said strip means having an inverted T-shape, said strip means including a generally inverted U-shaped central portion for straddling the stem of the T-bar, and arm means extending outwardly from said central portion beyond the arms of the T-bar for fastening to the channel member.

BRIEF DESCRIPTION OF DRAWING

The invention will be described in greater detail with reference to the accompanying drawing, which illustrates a preferred embodiment of the invention, and wherein.

Wherever possible in the drawing, the same reference numerals have been used to identify the same or similar elements.

DESCRIPTION OF PREFERRED EMBODIMENTS

Figure 1:
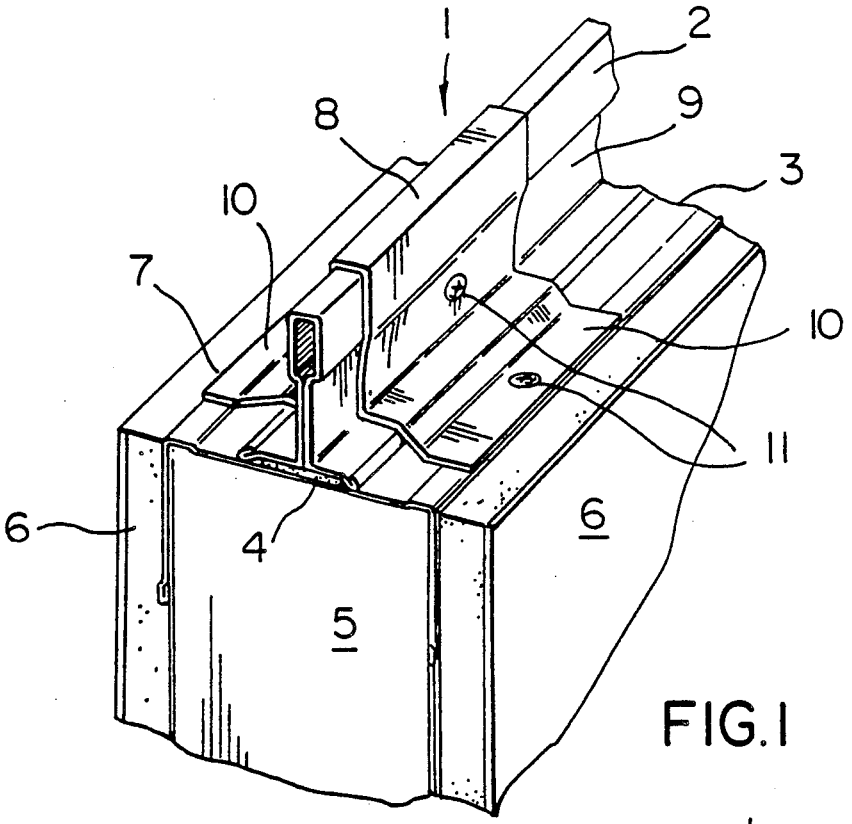
FIG. 1 is a perspective view from above and one end of a preferred embodiment of the connector device of the present invention.

With reference to FIG. 1, the connector device of the present invention which is generally indicated at 1 is intended for use when constructing internal walls or partitions in buildings containing conventional suspended ceilings. The suspended ceilings include a framework of so-called T-bars 2, which form a rectangular lattice for receiving ceiling tiles. One method of constructing walls utilizes the T-bars 2, and downwardly opening channel members 3 of C-shaped cross-section. The channel members 3 and rubber spacer strips 4 are connected to the T-bars 2 for receiving studs 5 also of C-shaped cross section which extend downwardly to other channel members (not shown) attached to the floor of the building. Wallboard or other finishing panels 6 are connected to the channel member 3 and possibly to the studs 5. Trim (not shown) is usually used to cover the joints between the panels and the screws connecting the panels to the channel members.

The connector device 1 of the present invention constitutes a simple means for suspendig a channel member 3 from a T-bar 2. As shown in FIG. 1, the simplest form of the present invention is a thin metal strip 7, the central portion 8, of which is wrapped around the stem 9 of the T-bar 2, and a pair of arms 10 integral with the central portion 8. The arms 10 extend outwardly from the central portion 8 so that the finished cross section of the strip is the same as that of the T-bar 2, i.e. the strip 7 generally conforms to the top of the T-bar. Self tapping screws 11 are used to connect the central portion 8 to the stem 9 of the bar 2 and the arms 10 to the channel member 3.

Figure 2:
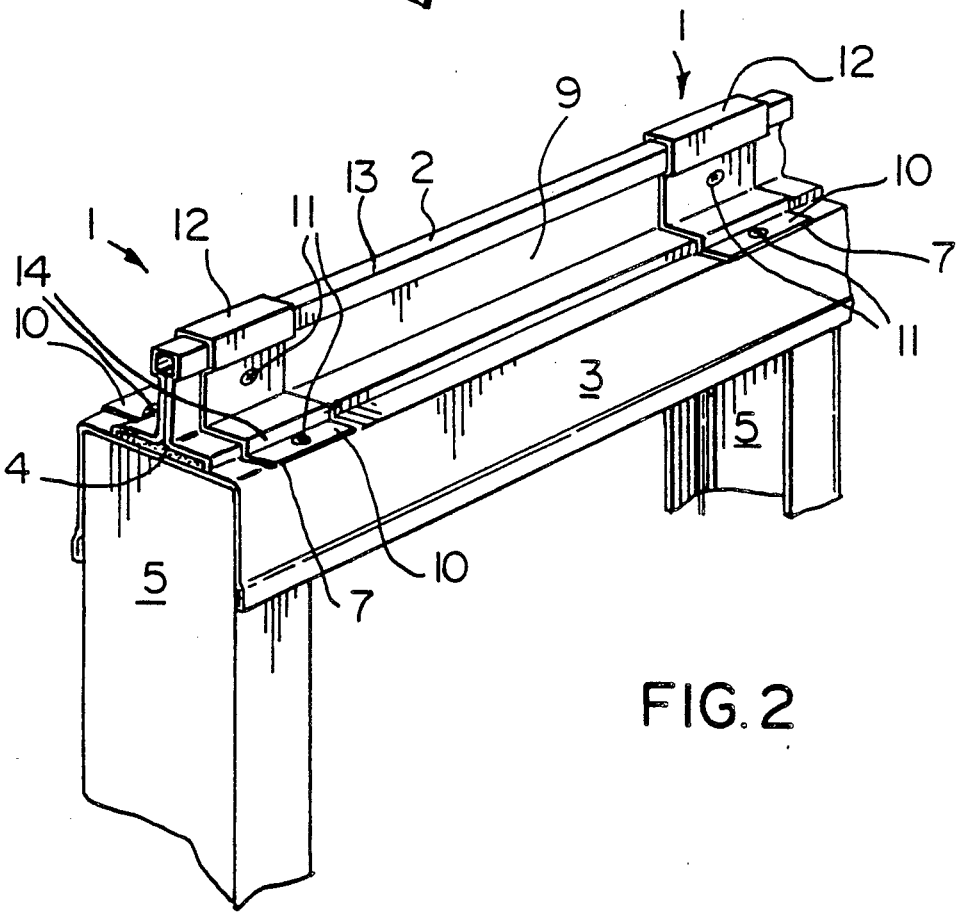
FIG. 2 is a perspective view from above and one side of the second embodiment of the connector device.

With reference to FIG. 2, a second embodiment is virtually identical to the first embodiment of the invention, except that the strip 7 is preformed to conform to the shape of the top of the T-bar 2. Thus, the strip 7 includes a head 12, which extends around the upper end 13 of the T-bar 2 and shoulders 14 in the arms 10.

I claim:

1. A connector device for connecting a generally C-shaped wall channel member to the base of a T-bar used in a conventional suspended ceiling assembly comprising elongated strip means for mounting on the T-bar, in use said strip means having an inverted T-shape, said strip means including a generally inverted U-shaped central portion for straddling and extending downwardly about the stem of the T-bar, and arms means extending outwardly from said central portion beyond the arms of the T-bar for overlying and fastening to the base of the channel member.

2. A connector device according to claim 1, wherein said strip means includes head means on said central portion for extending around the top end of said central portion; and shoulder means on said arm means for abutting the outer free ends of the arms of the T-bar, whereby the connector device conforms in shape to the top of the T-bar.

3. In combination, a generally C-shaped wall channel member connected by a connector device to the base of a T-bar used in a conventional suspended ceiling assembly, the improvement wherein said connector device comprises strip means mounted on the T-bar, said strip means having an inverted T-shape comprising a central stem portion and arms extending laterally outwardly from said central portion, said central portion being of inverted U-shape and straddling the stem of the T-bar, said arms of the connector device extending outwardly from said central portion over and beyond the arms of the T-bar so as to overlie at least part of the base of said channel member, and means supportably connecting the arms of the connector device to said channel member.

4. Apparatus as claimed in claim 3 wherein said connecting means connect the arms of the connector device to the base of the channel member laterally outwardly of the arms of the T-bar.

5. Apparatus as claimed in claim 4 wherein said connecting means comprise screws passing through the arms of the connector device and the base of the channel member laterally outwardly of the arms of the T-bar.

6. Apparatus as claimed in claim 4 further comprising second connecting means connecting the said U-shaped central stem portion with the stem of said T-bar.

7. Apparatus as claimed in claim 6 wherein said second connecting means comprise screws passing through at least one side of said U-shaped central stem portion and through the stem of said T-bar.

8. Apparatus as claimed in claim 3 wherein said laterally extending arms of said connector device do not extend beyond the lateral edges of the base of said channel member.

* * * * *